US006087754A

United States Patent [19]

Berger

[11] Patent Number: 6,087,754

[45] Date of Patent: Jul. 11, 2000

[54] CUT-OUT BRUSH FOR ELECTRIC HAND TOOL

[75] Inventor: Guenther Berger, Notzingen, Germany

[73] Assignee: Robert Bosch GmbH, Stuttgart, Germany

[21] Appl. No.: 09/284,792

[22] PCT Filed: Jul. 23, 1998

[86] PCT No.: PCT/DE98/02077

§ 371 Date: Apr. 20, 1999

§ 102(e) Date: Apr. 20, 1999

[87] PCT Pub. No.: WO99/13538

PCT Pub. Date: Mar. 18, 1999

[30] Foreign Application Priority Data

Sep. 10, 1997 [DE] Germany ..... 297 16 245 U

[51] Int. Cl.[7] ..... H02K 13/10; H01R 39/58; H01R 39/38

[52] U.S. Cl. ..... 310/240; 310/248; 310/251

[58] Field of Search ..... 310/240, 248, 310/249, 251

[56] References Cited

U.S. PATENT DOCUMENTS

| | | | |
|---|---|---|---|
| 2,016,173 | 10/1935 | McNeil | 310/248 |
| 2,454,562 | 11/1948 | Linke | 310/248 |
| 2,813,208 | 11/1957 | Ritter | 310/240 |
| 3,681,635 | 8/1972 | Bayer | 310/248 |
| 3,908,142 | 9/1975 | Gaudry | 310/242 |
| 5,648,706 | 7/1997 | Polk et al. | 318/376 |

FOREIGN PATENT DOCUMENTS

| | | | |
|---|---|---|---|
| 2094469 | 2/1972 | France | 310/248 |
| 2445636 | 7/1980 | France | 310/248 |
| 2496348 | 6/1982 | France | 310/248 |
| 87 09 324U | 9/1987 | Germany | 310/248 |
| 43 21 475 A1 | 1/1995 | Germany | 310/248 |

*Primary Examiner*—Nestor Ramirez
*Assistant Examiner*—Karl Eizo Tamai
*Attorney, Agent, or Firm*—Michael J. Striker

[57] ABSTRACT

A manual electric machine tool (10), having an electric motor (16), whose commutator (20) can be connected to a voltage source via at least one carbon brush (22) pressed against the commutator (20) by spring means (26), wherein the carbon brush (22) includes a head part (34) and a foot part (35) and has an electric pigtail lead (40) and a turn-off device (38), which at a certain wear of the foot part (35) of the carbon brush (22) automatically disconnects the electrical connection between the voltage source and the commutator (20), gains a longer useful life between service intervals for changing carbon brushes in that the carbon brush (22) is lengthened in the region of its head part (34) by a single axial continuation (36), which serves as a socket for the turn-off device (38) and is dimensioned such that the spring (26) enter flush and integrally into the outer contour of the carbon brush (22) between the outermost outer edges of the head part (34) and of the continuation (36), inside these outer edges.

6 Claims, 3 Drawing Sheets

CUT-OUT BRUSH FOR ELECTRIC HAND TOOL

PRIOR ART

The invention is based on a manual electric machine tool as generically defined by the preamble to claim 1.

From German Published, Non-Examined Patent Application DE-OS 43 21 475, a carbon brush for direct current electric motors is known, which in the region of its head part has two axial, stepped continuations that each act as a socket for one current-carrying pigtail lead. Between the continuations, a bearing face of fabric-base laminate for a pressure element and a damping overlay located beneath it is provided; the pressure element is intended to press the carbon brush against the commutator. The continuations protrude axially past the bearing face for the pressure element by only approximately 5% of the total length of the carbon brush. As a result, the known carbon brush has the disadvantage that it does not extend even nearly as far as the structural height of the pressure element or contact-pressure spring, or in other words as far as the axially farthest outward region thereof. Thus the region of the carbon brush that determines the service life of the carbon brush is relatively short, and thus the service life of the carbon brush is also relatively short. The outer diameter, determined by the position and size of the contact-pressure spring, of the electric motor equipped with the corresponding carbon brushes, and the corresponding housing region of the manual electric machine tool equipped with such a motor, is relatively large and is in no way optimal for a handle of the tool if the motor housing acts as a handle. An optimal, that is, the smallest possible, handle circumference of the manual electric machine tool is feasible only at relatively great difficulty, because there are limits to miniaturizing the collector diameter and the carbon brush length. The length of the carbon brush is determined by the difference between the collector radius and the outer radius of the housing, minus the spring protrusion (structural height) relative to the housing.

The known carbon brush is therefore too short for power tools whose handle is formed by the motor housing.

The known carbon brush also has no turn-off device that improves the safety of the power tool and that further reduces the usable carbon brush lengths, and so if the turnoff device were built into the known carbon brush, its running time would be even shorter than without the turn-off device.

ADVANTAGES OF THE INVENTION

The power tool of the invention having the characteristics of the body of claim 1 has the advantage over the prior art that with the turn-off device installed it is longer by 2 to 3 mm, so that the running time of the power tool until the next time the carbon brush has to be changed is lengthened by approximately 20 to 30 hours.

Because the spring means are embodied as a spiral spring, minimal installation space in the motor housing can be fully utilized for the maximum length of the carbon brush.

Because the spiral leaf spring is secured with its support arm region in a groove of the carbon brush position, it is assured that the carbon brush will be securely pressed in the direction of the carbon brush until the turn-off device responds, so that sparking and fire damage to the commutator can be precluded.

Because the head of the carbon brush is lengthened, the guidance performance with increasing wear and shortening of the carbon brush is better than in the earlier carbon brushes, because its guide faces are longer.

Because the flat side of the spiral spring is disposed substantially parallel and close to the narrow side of the carbon brush, an especially compact design of the brush holder is possible.

DRAWING

Exemplary embodiments of the invention are described in further detail in the description below in conjunction with the associated drawing.

Shown are

FIG. 1, a power tool embodied as a right angle grinder, having the carbon brushes of the invention, in fragmentary longitudinal section;

FIG. 2, the right angle grinder of FIG. 1 in a view from above with the motor housing partly cut away;

FIG. 3, the cross section of a further exemplary embodiment of a manual electric machine tool in the region of the carbon brush carrier;

FIG. 4, the detail of a carbon brush of the invention, cut along the broad side; and FIG. 5, the detail of the carbon brush of FIG. 4, looking at the narrow side.

DESCRIPTION OF THE EXEMPLARY EMBODIMENTS

Figure 1:
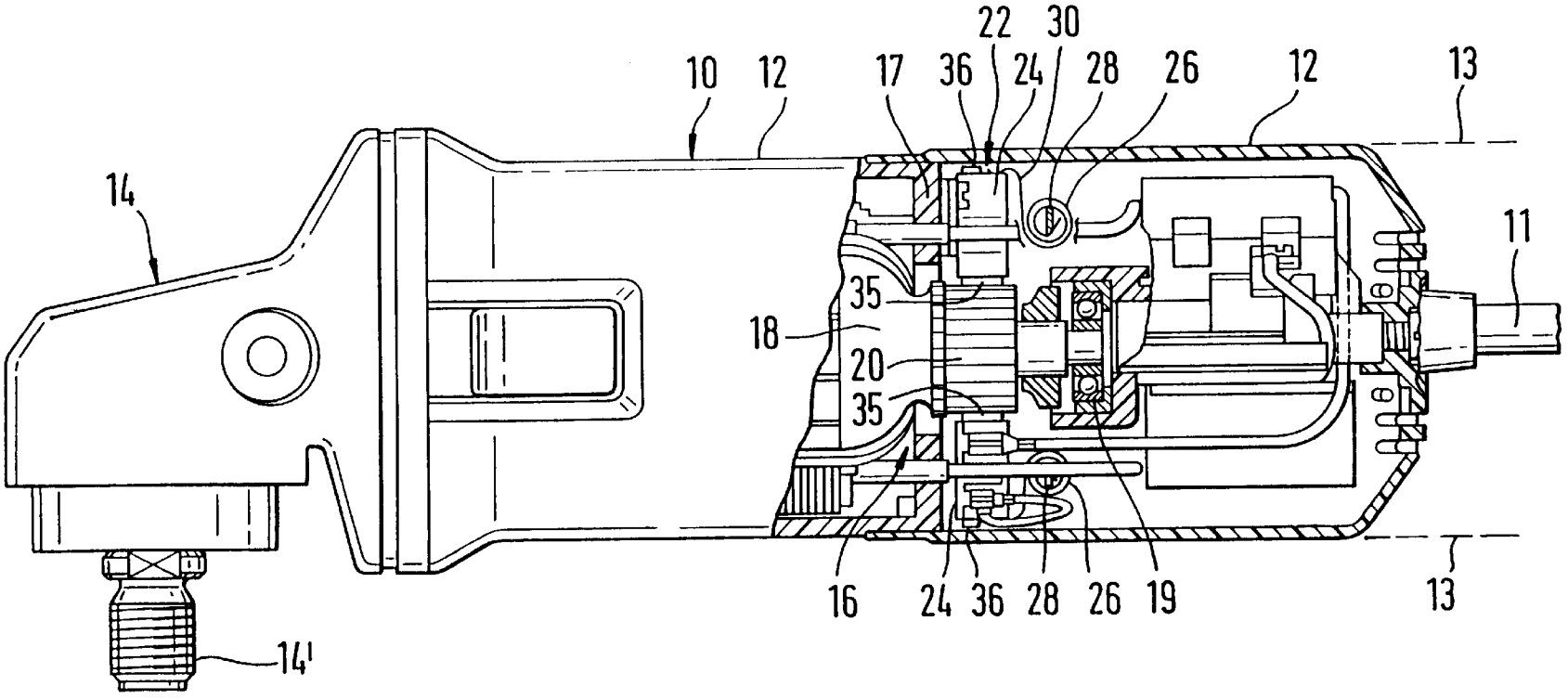

The manual electric machine tool shown in FIG. 1 is a right angle grinder 10, from behind whose motor housing 12 an electric connection cable 11 emerges; the outer contour 13 of the motor housing 12 is emphasized on opposite sides by a dashed line in each case, to show the relatively small outside diameter of the motor housing 12.

A gear housing 14 is flanged to the front of the motor housing 12 and has a power takeoff shaft 14' emerging at the bottom perpendicular to the axis of the motor housing. On the side, the motor housing 12 has a switch 15 for turning an electric switch that controls the motor on and off.

In the interior of the motor housing 12, a motor 16 can be seen, with a rotor 18 whose rear bearing 19 is braced centrally in the rear region of the motor housing 12.

Axially adjacent to the rear bearing 19, the rotor 18 has a commutator 20, on which radially elongated carbon brushes 22 of rectangular cross section are braced elastically; they are held in carbon brush guides 24 of rectangular tubular form that are disposed on a carrier 17 and structurally connected to the housing.

The carbon brush guides 24 have a side slot 25 (FIG. 3), through which a spiral spring 26 can reach laterally with its arm 30 and can follow the wear-dictated shifting of the carbon brush 22 toward the commutator 20.

Figure 3:
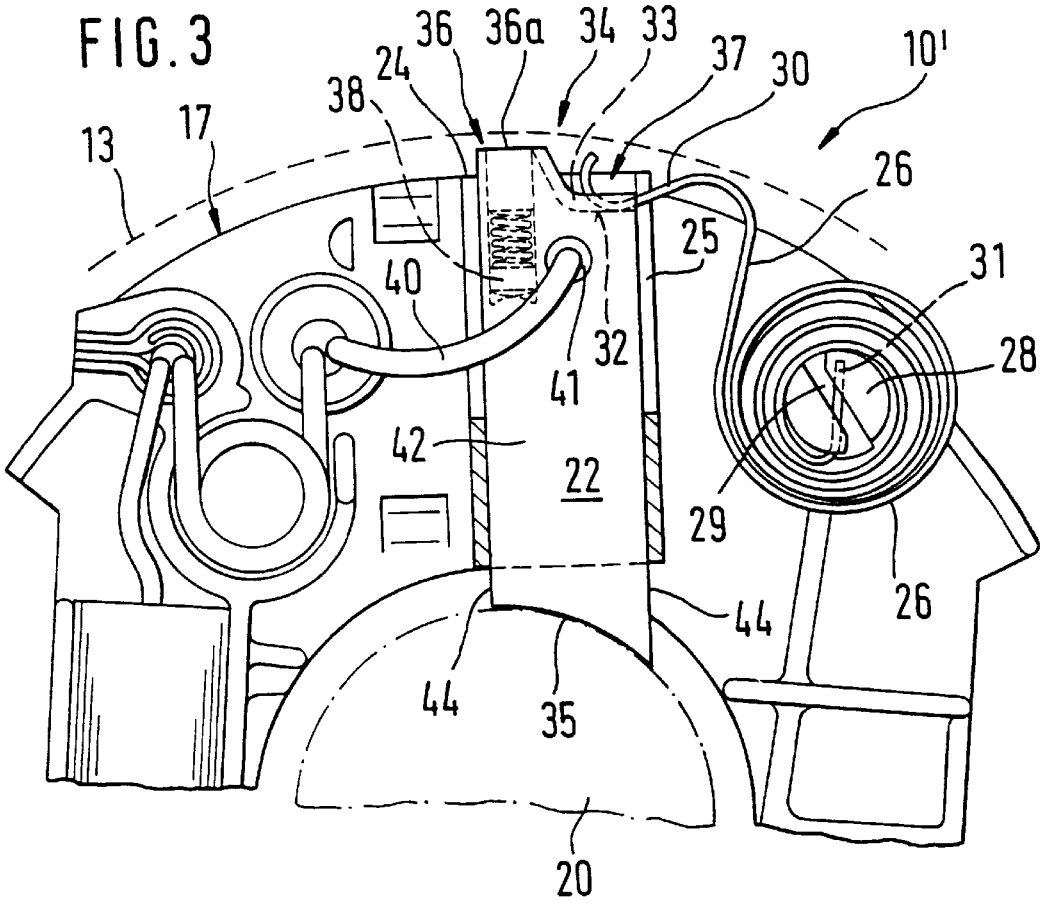

The spiral spring 26 is kept captive in the middle of its spiral region with a clamping end 31 in a slot 29 of a spring holder 28, and the support arm 30 of the spiral spring 26 opposite the clamping end 31 is braced at the top on the support face 32 of a head region 34 of the carbon brush 22 (FIG. 3). On the head region 34, the carbon brush 22 has a continuation 36, which protrudes radially past the radially outermost edge of the carbon brush guides 24. The foot region 35 of the carbon brushes 22 acts as a contacting and wearing part and is braced radially on the commutator 20.

Figure 2:
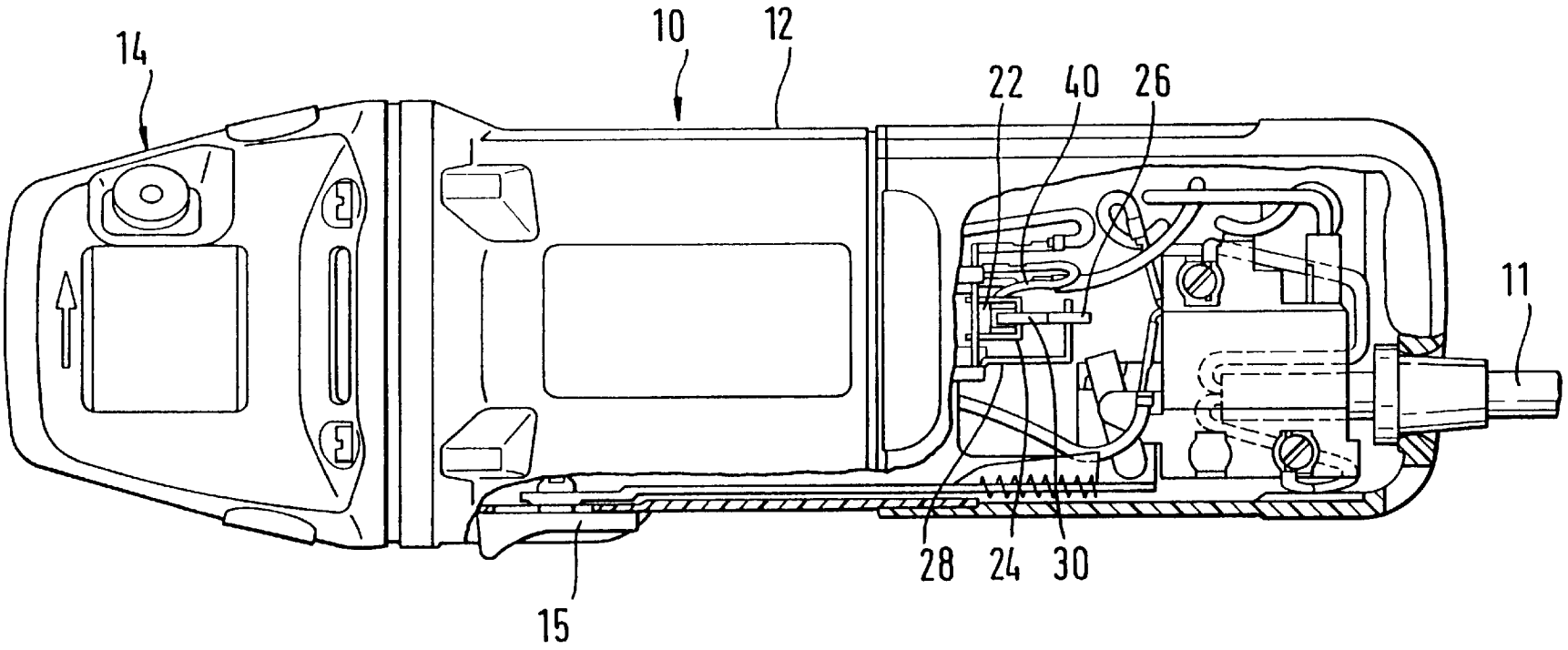

FIG. 2 shows a plan view on the power tool 10 of FIG. 1 and in particular clearly shows the position of the carbon brush guide 24 and the spiral spring 26, as well as of the spring holder 28 and an electrical connection pigtail 40, which is capable of flexibly following the motion of the carbon brush 22.

FIG. 3 shows only part of the upper half of the cross section, which continues in mirror symmetry toward the bottom, of a power tool 10'; unlike FIGS. 1 and 2, an exemplary embodiment of a commutator region is shown as a detail here, whose spiral springs 26 are rotated 90° relative to the longitudinal axis of the commutator 20. Accordingly, the spring holders 28 with the slots 29 are also rotated by 90° relative to the exemplary embodiment of FIGS. 1 and 2. The carbon brush 22 also has an oblique foot 35 and is laterally offset from the radial, beginning at the center point of the commutator 20. In this elevation view of the head region 24, an angular recess is clearly seen, in which a groove 33 also extends, into which groove the support arm 30 of the spiral spring 26 dips and is thus secured against slipping laterally away from the carbon brush 22.

It becomes particularly clear that the upper end of the carbon brush 22 protrudes to near the outer contour 13, and as a result both the region that carries the pigtail 40 and the turn-off device 38 (FIG. 4) that determines the wear length are guided radially maximally far outward. The upper end of the continuation 36 protrudes past the upper edge of the carbon brush guide 24. The side slot 25 in the carbon brush guide 22 can also be clearly seen.

Figure 4:
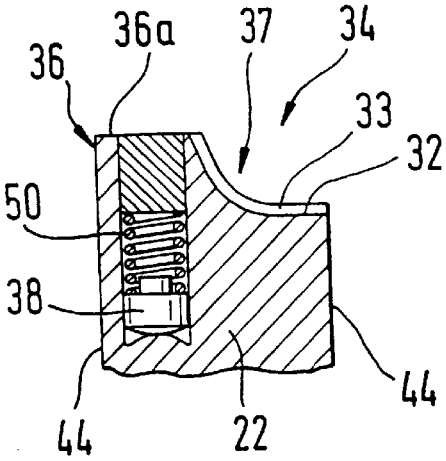

FIG. 4 shows the detail of a carbon brush 22 with a turn-off device 38 supported in socketlike fashion in the continuation 36; the angular recess is clearly seen, which is determined by the curved course of the support face 32, or of the face end 36*a* extending parallel to it of the head region 34 of the carbon brush 22; it is clear from FIG. 3 that the spring means 26 dip in flush fashion, with at least the region braced on the carbon brush 22, in the installed position of the carbon brush 22 into the upper outer contour or angular recess formed between the extensions of the upper end face 36*a* and of the side faces 42, 44.

Figure 5:
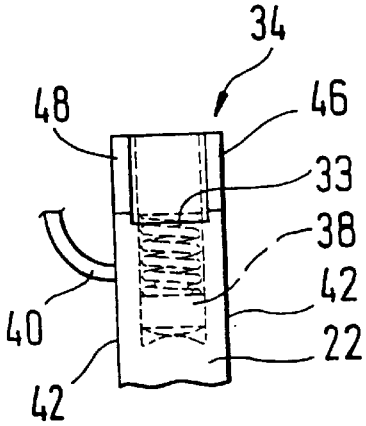

FIG. 5 shows the elevation view of the narrow side of the carbon brush 22 and clearly illustrates the disposition of the groove 33 and of the side walls 46, 48 of the carbon brush 22 that secure the position of the support arm 30 of the spiral spring 26.

The function of the turn-off device 38 is that with increasing wear, the lower edge of the turn-off device 38 can be supported freely, in the manner of a die, and resiliently by a compression spring 50 on the collector 20.

If this situation has occurred, when the upper wear limit is reached, the carbon brush 22 is pressed outward counter to the force of the spiral spring 26, so that contact between the current-carrying pigtail 40 and the commutator 20 is prevented. The electric motor then automatically turns off, so that damage to the commutator from contact with the pigtail 40, that is, sliding friction of metal on metal, at high rpm is prevented.

What is claimed is:

1. A manual electric machine tool (10), having an electric motor (16), whose commutator (20) can be connected to a voltage source via at least one carbon brush (22) pressed against the commutator (20) by spring means (26), wherein the carbon brush (22) comprises a head part (34) and a foot part (35) and has an electric pigtail lead (40) and a turn-off device (38), which at a certain wear of the foot part (35) of the carbon brush (22) automatically disconnects the electrical connection between the voltage source and the commutator (20), wherein the carbon brush (22) is lengthened in the region of its head part (34) by an axial continuation (36), which serves as a socket for the turn-off device (38) and is dimensioned such that a dip of the spring means (26), in particular in flush fashion, with at least their region braced on the carbon brush (22) in an installed position of the carbon brush (22), into an upper outer contour formed between extension of upper end face (36*a*) of the continuation and the extensions of the side faces (42, 44) of said brush.

2. The manual electric machine tool of claim 1, wherein as the spring means (26), a spiral spring is used, which extends with one, in particular curved end of the spiral region, preferably a support arm region (30), inside the outer contour of the carbon brush (22) and is braced on a support face (32) on the head part (34) of the carbon brush (22).

3. The manual electric machine tool of claim 2, wherein the support arm (30) is braced, positionally secured in a groove (33) in the head region (34) of the carbon brush (22).

4. The manual electric machine tool of claim 1, wherein the carbon brush (22) is embodied in elongated form of rectangular cross section with one broad side (42) and one narrow side (44).

5. The manual electric machine tool of claim 3, wherein one flat side of the spiral spring (26) is disposed substantially parallel and closely adjacent to a narrow side (44) of the carbon brush (22).

6. The manual electric machine tool of claim 3, wherein the electric pigtail lead (40) emerges approximately at a right angle from an broad side (42) of the carbon brush (22), preferably from an outlet opening (42).

* * * * *